United States Patent [19]

Lin

[11] Patent Number: 4,875,689

[45] Date of Patent: Oct. 24, 1989

[54] BALLS FOR TARGET GAMES

[76] Inventor: Yuh-Chorng Lin, 902 Chaparral Dr., Walnut, Calif. 91789

[21] Appl. No.: 321,105

[22] Filed: Mar. 9, 1989

[51] Int. Cl.[4] ..... A63B 65/00

[52] U.S. Cl. ..... 273/346; 273/DIG. 30; 24/444

[58] Field of Search ..... 273/346, DIG. 30; 24/444, 447, 92, 682

[56] References Cited

U.S. PATENT DOCUMENTS

| | | | |
|---|---|---|---|
| 158,178 | 12/1874 | Merrill | 24/682 |
| 3,031,730 | 5/1962 | Morin | 24/444 |
| 3,717,908 | 2/1973 | Perina | 24/444 |
| 3,732,600 | 5/1973 | Perina | 24/444 |
| 3,917,271 | 11/1975 | Lemelson et al. | 273/346 |
| 4,029,316 | 6/1977 | Clarke | 273/346 X |
| 4,053,156 | 10/1977 | Bai | 273/346 |

FOREIGN PATENT DOCUMENTS

| | | | |
|---|---|---|---|
| 644534 | 2/1964 | Belgium | 273/346 |
| 1489655 | 10/1977 | United Kingdom | 273/346 |

OTHER PUBLICATIONS

Playthings, Rec'd 2-22-77, Johnny Bench Baseball.

*Primary Examiner*—Paul E. Shapiro

*Attorney, Agent, or Firm*—Boniard I. Brown

[57] ABSTRACT

A ball for target games has interengaging material for detachable adherence to an interengaging fabric surface of a target. A strip of the material has at least one curved portion. The ball has spaced openings along the extent of the strip or strips, and a strip portion extends through each opening. The strip may comprise a plurality of segments. The strip material and the target interengaging fabric surface each comprises a multiplicity of interengaging elements. The strips are adhesively secured to the ball surface. The openings may comprise spaced-apart pairs of openings, each separated by a wall portion, with the strip extending through each of the openings and retained by the wall portion. In another form, end portions of adjacent strip segments extend into a single opening and are secured to the edge walls of the opening and to the adjacent interior wall surface. A groove may be defined in the ball surface of such configuration and size as to receive the strip with the interengaging surface elements thereof extending above the ball surface adjacent to the groove. The groove may be deeper on the outside of the curved portion of the strip than on the inside to reduce the circumferential extent of the strip outside edge. A plurality of spaced-apart notches or slits may be defined in the inside of the strip curved portion to reduce the effective length of the inward edge portion for improved securement of the strip.

27 Claims, 1 Drawing Sheet

BALLS FOR TARGET GAMES

BACKGROUND OF THE INVENTION

The present invention relates to improved structures and means for the securement of strips of interengageable material to the surfaces of hollow balls for the purpose of preventing detachment of such strips.

Such balls are utilized in games wherein they are tossed or thrown to a target having or cooperating interengaging material surface to which they detachably adhere.

Balls partially covered with strips of interengageable material or Velcro material are known in the prior art for use in games for throwing at a fabric target to which the balls adhere upon contact. Such interengageable materials are well-known, and are known as burr materials involving a face or pile of hook-like elements on one material, and loop or other hook-engageable elements of pile on the other interengageable material.

The securement of such strips to spherical ball surfaces has involved the problem of a marked tendency to become disengaged from repeated impact, bouncing, and handling. This is particularly true with respect to the inside edges of curved portions of such strips on which inside edges or edge portions tend to bunch, fold, or bend up, and become detached, largely because of the lesser distance the inside edge extends in comparison with the distance the outside edge of a curved portion extends. The process of separation or peeling off accelerates and spreads, once started. Partial or extensive disengagement of a strip renders the strip much less effective in engaging a fabric surface onto which the ball is tossed. Such disengagement or peeling-off interferes with the aerodynamic behavior of a ball being tossed, resulting in inaccurate and undesired trajectories of such balls.

Various approaches have been taken in efforts to solve such problems. U.S. Pat. No. 4,053,156 relates to an arrangement wherein the ends of Velcro-type strips are anchored in depressions on a ball by separate plug members frictionally retained by bushings. The ball structure of U.S. Pat. No. 4,029,316 involves two rim components about a ball and intersecting at right angles, with flat tread surfaces covered with tapes having interengageable material on non-stretchable backing. U.S. Pat. No. 4,415,154 shows a ball with strip material wound thereon.

SUMMARY OF THE INVENTION

The present invention provides a ball having an interengaging fabric surface for detachable adherence to a cooperating interengaging fabric of a target surface. The ball comprises a hollow spherical wall and strip material attached to the spherical surface of the ball and having thereon a first interengaging fabric surface, and attachment means for securement of the strip, comprising radially extending openings in the spherical wall, the openings having opposite edge walls and being adapted for extension therethrough of strip portions to engage at least one wall portion. A plurality of the openings are spaced along the extent of the strip and may typically comprise a plurality of segments. The interengaging fabric surfaces comprise a multiplicity of interengaging elements, typically hook elements and loop elements. The openings may preferably be spaced-apart pairs of openings, each pair separated by a wall portion, with the strip extending through each opening and being retained by the wall portion. In another preferred arrangement, adjacent end portions of strip segments extend into the opening and are secured about edge walls of the opening and on the adjacent interior wall surface areas, as by adhesive. A groove may be defined in the ball surface of such configuration, width and depth that the strip is received with its interengaging surface extending above the outer ball surface adjacent to the groove. The strip has at least one curved portion on which may be defined a plurality of spaced-apart notches in the inward edge portion, which notches are closed to an appropriate degree to reduce the effective length of the inside edge portion in relation to the outside edge portion. Slits may be defined in the inward edge portion of a strip curved portion, instead of notches, the slit edges overlapping to reduce the effective length of the inside edge portion.

DESCRIPTION OF THE PREFERRED EMBODIMENTS

Figure 1:
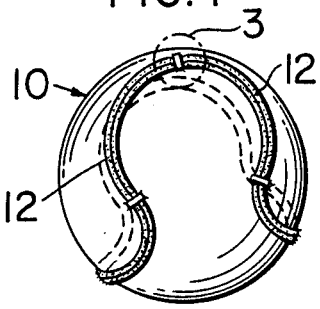
FIG. 1 is a perspective view of a hollow ball with Velcro strips attached thereto, in accordance with the present invention.
Figure 2:
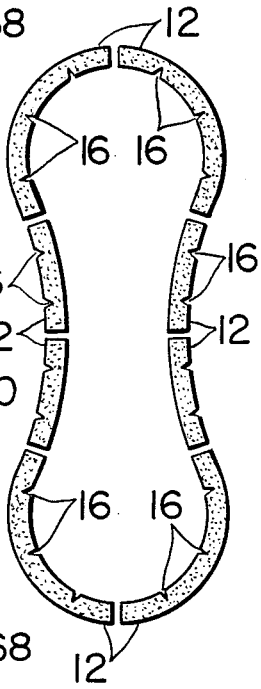
FIG. 2 is a plan view of a plurality of strip segments in a configuration which provides a pattern on a spherical ball simulating the stitching pattern on a baseball or softball.

Referring to the drawings, FIG. 1 shows a preferred form of ball construction 10 on the spherical surface of which are attached Velcro-type strip segments 12. The strip segments are in a generally "8" configuration, as shown in FIG. 2, to provide a pattern on the ball which simulates the stitching of a baseball.

The inner edges of the strip segments have notches 16 spaced therealong for a purpose hereinafter described. The strip or strip segments may be attached to the ball surface by pressure-sensitive adhesive provided on the strips, with a removable backing layer or paper, or the strips may be attached by application of appropriate liquid adhesive.

The strips or strip segments are formed of a fabric having thereon a multiplicity interengageable elements to provide an interlocking fabric which will releasibly engage and interlock with the surface elements of another material upon contact, as when the ball is tossed onto a target. Such interlocking fabrics, typically of appropriate plastic material, are well-known. Upon engagement of the two surfaces, the hook elements of one surface become engaged with the loops or napped surface, etc., of the other surface, and the materials become detachably secured by such surface engagement. This precludes inadvertent separation of the two fabric surfaces without the intentional pulling of one from the other.

Figure 3:
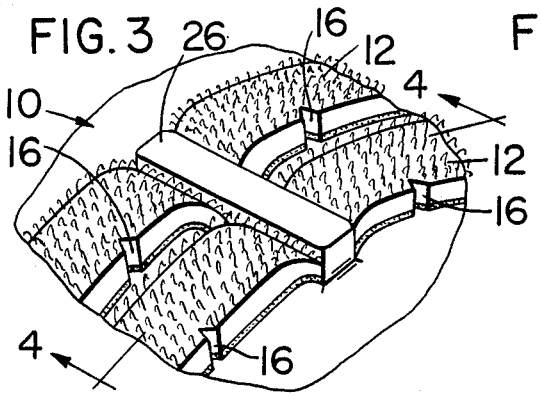
FIG. 3 is a fragmentary perspective view of the portion encircled at 3 in FIG. 1, and illustrating a preferred form of strip-attachment structure.
Figure 4:
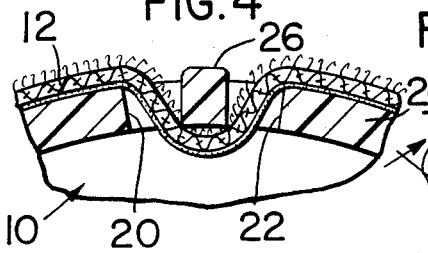
FIG. 4 is a sectional view taken at line 4—4 in FIG. 3.

FIGS. 3 and 4 illustrate a preferred arrangement for the attachment of strips, wherein radially extending openings 20, 22 are defined in wall 24 of the ball and are separated by a wall portion or bar 26, which extends outwardly from the outer surface of the ball wall to approximately the level of the outer ends of the surface elements of strips 12, thus providing a more even outer ball surface by filling the space above the bar. Each strip or segment 12 extends through the openings and engages the underside of the wall portion 26, and is &thus firmly attached to and retained on the ball. A plurality of pairs of openings 20, 22 are spaced along the pattern of the strip or strips on the ball to provide securement at such spaced intervals.

Figure 5:
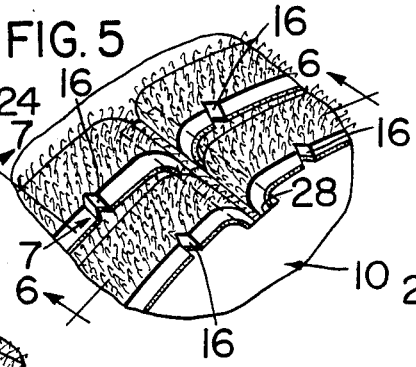
FIG. 5 is a view, similar to the view of FIG. 3, showing another form of strip attachment structure.
Figure 6:
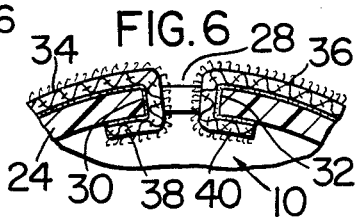
FIG. 6 is a sectional view taken at line 6—6 in FIG. 5.

FIGS. 5 and 6 illustrate another preferred arrangement for the securement of strip or strip segments on a ball, FIG. 5 showing this arrangement in a view similar to the view of FIG. 3. An opening 28 is defined in the wall and has edge walls 30, 32. End portions of adjacent strip segments 34, 36 extend into the opening and engage the adjacent wall portion, being secured about the edge walls and the adjacent interior surface areas of the wall, as by adhesive, with portions 38, 40 of the strips secured to the interior surface areas of the wall, as shown. A plurality of such openings for strip securement are spaced along the pattern of the strip or strips on the ball to provide securement at spaced intervals.

Figure 7:
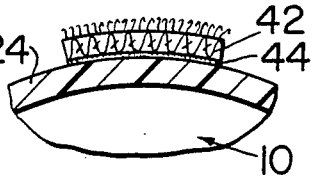
FIG. 7 is a sectional view taken at line 7—7 in FIG. 5.

FIG. 7 shows in cross-sectional view, a strip portion 42 secured by adhesive on the spherical surface of wall 24 of a ball.

Figure 8:
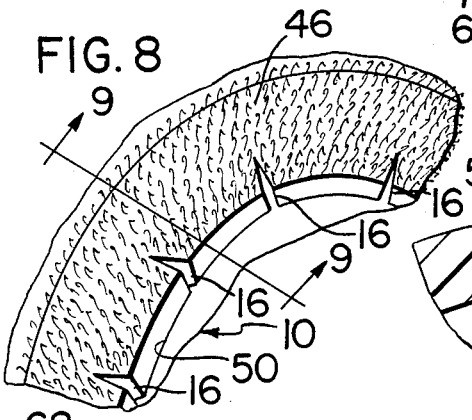
FIG. 8 is a fragmentary perspective view of a curved portion of a strip in a groove in a ball surface, according to the invention.
Figure 9:
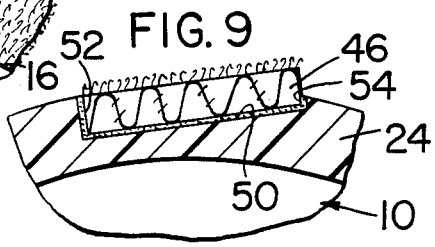
FIG. 9 is a sectional view taken at line 9—9 in FIG. 8.

FIGS. 8 and 9 illustrate a curved portion of a Velcro-type strip 46 disposed in a curved portion of a groove 50 according to the invention, which is defined in the spherical ball surface to provide improved strip retention, particularly at curved portions of strip. The groove is preferably deeper at its edge wall 52 on the outside of a curved portion than on the inside edge wall 54. Improved resistance of the strip to becoming disengaged is provided. It will be understood that the outer edge of the strip and groove on a curved portion must extend a longer distance about the ball than the inner edge, between two points on the ball surface. It will be understood from the geometry of the arrangement that, with the groove being deeper on the outer edge portion, the groove radius is reduced and the extent the outer edge portion of the strip must extend circumferentially is reduced. The tendency of the inner edge portion to become disengaged is therefore greatly reduced because it is not compressed or bunched. Desirably, the arrangement would be adjusted so that the inner edge length equals the outer edge length between two points on the spherical surface.

Referring to FIGS. 2 and 8, strip 46 has spaced notches on the inside or inward edge defined portions of curved sections of the strip. These are shown folded or partially closed, thus to compensate for the lesser distance the inner edge of the strip must extend in comparison with the outer edge thereof, as between two points on the spherical ball surface. In order to prevent upward bunching, bending or "curling up" of the inner edge portion of the strip on a curve, and therefore the strip becoming detached, the notches serve to reduce the effective length of the inner edge portion of the strip and to take up the excess edge material, thus greatly reducing the tendency for the inner edge portion of the strip to become detached in service. That is, this arrangement tends to equalize the effective lengths of the inside and outside edge portions.

Figure 10:
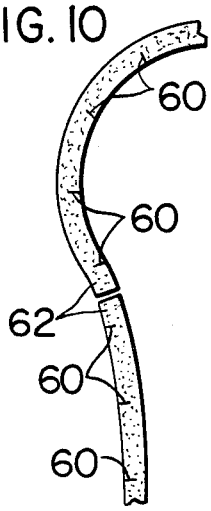
FIG. 10 is a plan view of a curved portion of strip, showing a spaced slits arrangement in accordance with the invention.

FIG. 10 illustrates a plurality of slits 60 spaced along the inner edge portion of a curved portion of strip 62, which arrangement may be utilized instead of the above-described notches arrangement. On the inner edge portion of a curved strip, the slits edges are overlapped, thus reducing the effective length or extension of the inner edge portion in relation to the length or extension of the outer edge portion between two points on the spherical surface. This slits arrangement thus serves the same purpose as the above-described notches arrangement.

Figure 11:
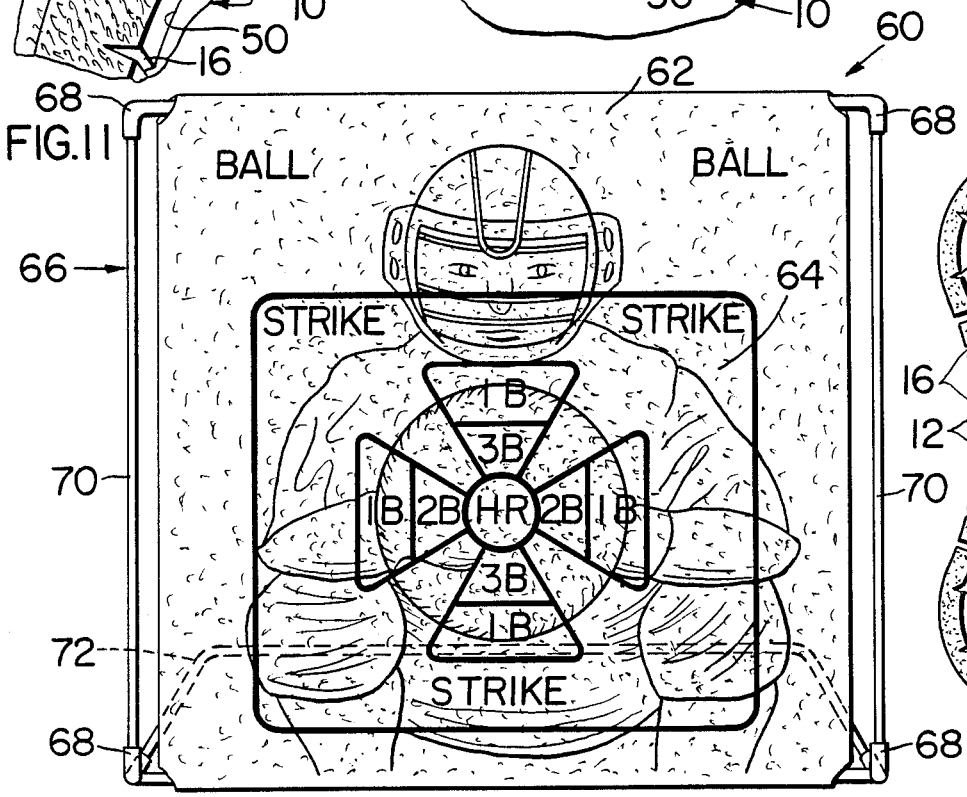
FIG. 11 is an elevational view of a target fabric display mounted on a frame arrangement for use with strips-mounted balls according to the invention.

A form of target with which balls of the invention may be utilized is shown in FIG. 11. The target 60 comprises a fabric panel 62, typically of a flannel double-knit or napped material, bearing indicia including a scoring layout 64. The fabric panel is mounted on an appropriate frame structure 66, including corner socket members 68, hollow rods 70, and a rearwardly extending support or base portion 72 which rests on the ground or floor. The fabric of the panel provides pile material to engage the hooks or burr material of the ball strips to cause the ball to adhere to the fabric target surface upon engaging or impacting the same. Often, a ball first impacts the target fabric then rolls downwardly thereon to a limited degree before adherence of the ball to the fabric.

A primary use of balls according to the invention is in the simulation of portions of a baseball game. The arrangement of the Velcro-type strips on the ball surface simulates the pattern of the stitching on a baseball or softball. The scoring pattern or outline 70 on the fabric panel 68 is shown in relation to the center of a catcher's mitt, and the indicia shows scoring areas or outlines of areas for 1B (one base hit), 2B (two base hit), 3B (three base hit), HR (home run), STRIKE and BALL. In utilizing the game apparatus, a player tosses the ball toward the target fabric panel 68. The tossing of the ball may simulate the trajectory of a baseball or softball, and the ball may be manipulated and thrown to so simulate such trajectory on a reduced scale. The player scores in accordance with the position at which his ball is adhered to the display on the target fabric panel 68. A player may score a home run (HR) if his ball lands at the center of the catcher's glove, a base hit in accordance with the position on the target display at which his ball becomes attached, and a player may suffer a strike if his ball lands outside the indicated scoring area.

Thus there has been shown and described novel balls for target games which fulfill all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A ball with a first interengaging fabric surface for detachable adherence o a second target interengaging fabric surface, the ball comprising:

a hollow spherical wall having a radial thickness and a spherical outer surface, at least one strip of material having thereon the first interengaging fabric surface, attached to the spherical surface of the ball and having at least one curved portion, and attachment means on the ball for securement of the at least one strip thereto, said attachment means comprising at least one radially extending opening in the ball wall, said opening having opposite edge walls and being sized and adapted for extension therethrough of portions of the strip for engagement with at least one wall portion to secure the strip to the ball.

2. A ball according to claim 1, wherein:

a plurality of openings are spaced along the extent of the strip on the spherical ball surface, and a strip portion extends through each of the openings.

3. A ball according to claim 2, wherein: each of the first and second interengaging fabric surfaces comprises a multiplicity of interengaging elements.

4. A ball according to claim 2, wherein: the strip material is adhesively secured to the spherical surface of the ball.

5. A ball according to claim 2, wherein: the ball is formed of thermoplastic material by molding.

6. A ball according to claim 2, wherein:

said openings comprise spaced-apart pairs of openings, the openings of each pair being separated by a portion of the wall, and the strip extends through each of the openings and is retained by the wall portion.

7. A ball according to claim 6, and further including:

a groove defined in the spherical surface of the ball, the groove having such configuration, width and depth as to receive the strip with the interengaging surface thereof extending above the ball outer surface adjacent to the groove.

8. A ball according to claim 7, wherein:

the groove is deeper at its edge wall on the outside edge of the curved portion of the strip than on the inside edge, whereby the distance the outer edge portion of the strip must extend circumferentially of the ball between two points on the strip is reduced in relation to the distance the inner edge portion of the strip must extend between the same two points, whereby the effective length of the outer edge portion is reduced.

9. A ball according to claim 2, wherein:

said strip comprises strip segments in end-to-end relation on the ball surface, and end portions of adjacent strip segments extend into the openings and are secured about respective ones of the edge walls of the openings and on the adjacent interior wall surface areas.

10. A ball according to claim 9 wherein:

the strip end portions are adhesively secured to said edge walls and to said interior wall areas.

11. A ball according to claim 9, and further including:

a groove defined in the spherical surface of the ball, the groove having such configuration, width and depth as to receive the strip with the interengaging surface thereof extending above the ball outer surface adjacent to the groove.

12. A ball according to claim 11, wherein:

the groove is deeper at its edge wall on the outside edge of the curved portion of the strip than on the inside edge, whereby the distance the outer edge portion of the strip must extend circumferentially of the ball between two points on the strip is reduced in relation to the distance the inner edge portion of the strip must extend between the same two points, whereby the effective length of the outer edge portion is reduced.

13. A ball according to claim 2, and further including:

a groove defined in the spherical surface of the ball, the groove having such configuration, width and depth as to receive the strip with the interengaging surface thereof extending above the ball outer surface adjacent to the groove.

14. A ball according to claim 13 wherein:

the groove is deeper at its edge wall on the outside edge of the curved portion of the strip than on the inside edge, whereby the distance the outer edge portion of the strip must extend circumferentially of the ball between two points on the strip is reduced in relation to the distance the inner edge portion of the strip must extend between the same two points, whereby the effective length of the outer edge portion is reduced.

15. A ball according to claim 2, wherein:

the curved portion of the strip has a plurality of spaced-apart notches defined in its edge portion on the inward side of the curve, said notche's being closed to an appropriate degree, whereby the effective length of the inward edge portion is reduced in relation to the outward edge portion for improved securement of the inward edge portion of the ball surface.

16. A ball according to claim 2, wherein:

the curved portion of the strip has a plurality of spaced-apart slits defined in its edge portion on the inward side of the curve, said notches have their respective edges overlapped to an appropriate degree, whereby the effective length of the inward edge portion is reduced in relation to the outward edge portion for improved securement of the inward edge portion of the ball surface.

17. A ball according to claim 1, wherein:

the strip comprises a plurality of strip segments.

18. A ball according to claim 1, wherein:

each of the first and second interengaging fabric surfaces comprises a multiplicity of interengaging elements.

19. A ball according to claim 18 wherein:

the interengaging elements on one of said interengaging fabric surfaces are hook elements and the elements on the other interengaging surface are adapted to interengage with the hook elements.

20. A ball according to claim 18, wherein:

said openings comprise spaced-apart pairs of openings, the openings of each pair being separated by a portion of the wall, and the strip extends through each of the openings and is retained by the wall portion.

21. A ball according to claim 18, wherein:

said strip comprises strip segments in end-to-end relation on the ball surface, and end portions of adjacent strip segments extend into the openings and are secured about respective ones of the edge walls of the openings and on the adjacent interior wall surface areas.

22. A ball according to claim 18, wherein:

the curved portion of the strip has a plurality of spaced-apart notches defined in its edge portion on the inward side of the curve, said notches being closed to an appropriate degree, whereby the effective length of the inward edge portion is reduced in relation to the outward edge portion for imrpoved securement of the inward edge portion of the ball surface.

23. A ball according to claim 18, wherein:

the curved portion of the strip has a plurality of spaced-apart slits defined in its edge portion on the inward side of the curve, said notches have their respective edges overlapped to an appropriate degree, whereby the effective length of the inward edge portion is reduced in relation to the outward edge portion for improved securement of the inward edge portion of the ball surface.

24. A ball according to claim 1, wherein:

the strip material is adhesively secured to the spherical surface of the ball.

25. A ball according to claim 1, wherein:

the ball is formed of thermoplastic material by molding.

26. A ball according to claim 1, and further including:

a groove defined in the spherical surface of the ball, the groove having such configuration, width and depth as to receive the strip with the interengaging surface thereof extending above the ball outer surface adjacent to the groove.

27. A ball according to claim 26 wherein:

the groove is deeper at its edge wall on the outside edge of the curved portion of the strip than on the inside edge, whereby the distance the outer edge portion of the strip must extend circumferentially of the ball between two points on the strip is reduced in relation to the distance the inner edge portion of the strip must extend between the same two points, whereby the effective length of the outer edge portion is reduced.

* * * * *